US007857363B2

(12) United States Patent
Navarsky

(10) Patent No.: US 7,857,363 B2
(45) Date of Patent: Dec. 28, 2010

(54) DEVICE AND METHOD OF SEALING A FREIGHT CONTAINER

(75) Inventor: Eliezer Navarsky, Migdal Ha'emek (IL)

(73) Assignee: Navatech Container Security, LLC, Miami, FL (US)

( * ) Notice: Subject to any disclaimer, the term of this patent is extended or adjusted under 35 U.S.C. 154(b) by 410 days.

(21) Appl. No.: 11/362,510

(22) Filed: Feb. 27, 2006

(65) Prior Publication Data

US 2007/0200372 A1 Aug. 30, 2007

(51) Int. Cl.
*B65D 27/30* (2006.01)

(52) U.S. Cl. ..... 292/315; 70/49

(58) Field of Classification Search ..... 292/315, 292/317, 319, 321, 323–325, 327, 307 A; 70/49

See application file for complete search history.

(56) References Cited

U.S. PATENT DOCUMENTS 4,982,985 A * 1/1991 Atlas ..... 292/327
5,125,700 A * 6/1992 Fattori et al. ..... 292/318
5,553,904 A 9/1996 Lorenzo
5,647,620 A 7/1997 Kuenzel
6,113,163 A * 9/2000 Liroff ..... 292/307 R
6,293,362 B1 * 9/2001 Sasaki et al. ..... 180/274
6,293,599 B1 * 9/2001 Garcia ..... 292/317
6,331,022 B1 12/2001 Liroff
7,063,362 B1 * 6/2006 Liroff ..... 292/315
7,178,841 B1 * 2/2007 Moreno ..... 292/327

* cited by examiner

*Primary Examiner*—Gary Estremsky
(74) *Attorney, Agent, or Firm*—Banner & Witcoff, Ltd.

(57) ABSTRACT

The invention is a locking arrangement for securely sealing the doors of a freight container. The container comprises two locking rods, each of which is fixed to one of each of the doors. A handle is pivotably connected to the first locking rod. The handle comprises a first opening situated at a location along its longitudinal length. A seal clasp is joined to the first of the doors. The said seal clasp comprises a second opening aligned with the first opening. The locking arrangement comprises a sealing device comprising a bolt seal and a cable. The bolt seal comprises an insertion bolt comprising an elongated body, an enlarged base and a securing tip. The bolt seal further comprises a locking bush into which the securing tip is inserted. The cable comprises a first end and a second end joined to the bolt seal. When the cable is wrapped around the locking rods, and when the insertion bolt is disposed through the first and second openings, the doors are securely sealed.

8 Claims, 9 Drawing Sheets

DEVICE AND METHOD OF SEALING A FREIGHT CONTAINER

FIELD OF THE INVENTION

The present invention relates in general to a security device. In particular, the present invention relates to a device and method of indicating whether or not a sealed container has been tampered with.

BACKGROUND OF THE INVENTION

Modern freight transportation often involves the shipping of cargo across the world by land, sea and air. Typically, freight is packaged in an intermodal container and sealed to indicate and/or prevent unwanted entry thereto. From the moment of departure of the freight until it reaches its final destination, the container may be loaded and unloaded to and from a number of cargo carriers (e.g. trucks, rail cars, ships, planes, etc.) depending on the distance and route to be traveled. Over the course of its transportation, the container may be left unattended for extended periods of time, at which time a thief may attempt to break into the container and pilfer some or all of its contents. Nowadays, an additional concern is that a terrorist may attempt to insert weapons or explosives into the container.

A close-up picture of a door of a freight container is shown in FIG. 1. Traditionally, freight containers are sealed by securing at least one handle (1) to the container door (9) with a seal (2), which prevents the handle (1) from being allowed to rotate, thereby preventing the door from being opened. However, the pin (3) that pivotally connects one end of the handle (1) to the locking rod (4) which is joined to the container door (9) may be easily removed, for example, by a cold chisel and hammer. As shown in FIG. 2, with the pin (3) removed, the locking rod (4) may be rotated and the container door opened without ever removing the seal (2) from the handle (1). A substitute pin can be easily placed in the pin hole after closing the container door. Thus, the contents of the container may be removed and/or a weapon or explosive may be inserted without any evidence of tampering. When the security breach is finally detected, it may be difficult to determine where and when it took place along the transportation route.

One way of overcoming the deficiencies of the sealing mechanism described above is to provide a jacket and sleeve member for enclosing the hinging pin. Such a device is disclosed in U.S. Pat. No. 5,553,904. However, removing this device is not a difficult task, and replacing it may not be necessary, since an inspector or person who handles the container will note that the pin is still in place (even though it is actually a substitute for the original pin) and may not even know that the jacket and sleeve device was originally there as well. Alternatively, a thief may attempt to replace the jacket and sleeve with a suitable substitute.

An additional concern, when providing sealing containers, is to conform to the relatively new container sealing requirements dictated by the U.S. Customs Trade Partnership Against Terrorism (C-TPAT) and the ISO/PAS 17712 High Security standard. According to the C-TPAT requirements, a bolt seal conforming to the "High Security" grade as per ISO/PAS 17712 must be utilized for container sealing. Moreover, when a cable seal is utilized, the ISO/PAS 17712 High Security grade shear strength requirement effectively translates to a 4 mm thickness. These requirements can add cost to the manufacture and, therefore, sale price of seals and in particular door to door cable seals, which may be prohibitive to some manufacturers and consumers.

It is interesting to note that there are a number of deficiencies involved with bolt seals. In particular, although bolt seals possess high tensile strength, in many, if not most models, removal of the insertion bolt from the locking bush is achievable by a technique known as, "spinning". In "spinning", one end of the bolt seal, e.g. the insertion bolt, is fixedly held, while the other end, e.g. the locking bush, is inserted to a drill chuck. When the drill is turned on and the locking bush is rotated at a high speed, the locking bush may be removed from the insertion bolt by applying a sudden downward force to the locking bush. Despite this deficiency, the bolt seal has been accepted as a high security solution.

U.S. Pat. No. 6,293,599 discloses a disposable cable seal device for preventing opening of the container doors as well as providing indication of whether the container had been opened without authorization. The device comprises an elongated tube into which an insertion pin is secured. A steel cable is attached at one end to the tube and at the other end to the pin. When the cable is wrapped around the locking rods of the doors of a container, and the pin is inserted to the tube, the doors are secured shut. The device may be removed only by either cutting through the cable or by destroying the insertion pin and/or elongated tube. Either way, it is evident that tampering with the container has taken place. Additionally, a unique identifying mark, e.g. a serial number, is etched on the outer surface of the tube, such that upon close inspection of the number or mark, it may be determined whether one device has been removed and replaced by a different device having a different identifying mark on the housing. However, the device of U.S. Pat. No. 6,293,599 has a number of shortcomings. In particular, the cable is wrapped around the locking rods that are attached to the doors of the container. As is well known in the industry, the configuration of containers from different manufacturers, including the distance between locking rods, varies. Hence, as shown in FIGS. 3 and 3A in U.S. Pat. No. 6,293,599, the cable of the device should be made having enough length to be capable of being wrapped around a large number of locking rod configurations. Depending on the slack of the cable, a thief may be capable of at least partially opening the container doors and removing at least some of the contents, without evidence of tampering. Moreover, the device described in U.S. Pat. No. 6,293,599 is required to comply with the ISO/PAS 17712 "High Security" grade requirements for usage under the C-TPAT initiative.

U.S. Pat. No. 6,331,022 discloses a seal assembly for securing container doors in a closed position. The invention is a multi-component assembly for providing supplemental sealing of the container doors. In particular, the assembly comprises an elongated cable having mating and/or locking segments at one or both of its ends. One end of the cable is situated in the seal clasp of the container door handle, and the other end of the cable is situated in a tamper evident cargo container door seal. The tamper evident seal comprises a horizontal cross-bar disposed transversally with respect to the locking rods. A c-shaped bracket having slots through which the cross-bar sits, and a bore through which one end of the cable is inserted, is positioned around at least the locking rod closest to the other end of the cable. In such a configuration, multiple levels of protection are provided for the container. However, this assembly is expensive, unnecessarily complex and requires installation and removal which takes time and skill to perform.

It is therefore an object of the present invention to provide a tamper indication device and method that overcomes the drawbacks of prior art devices.

It is an additional object of the present invention to provide a sealing device that prevents the opening of freight container doors.

It is an additional object of the present invention to provide a sealing device that conforms with the C-TPAT initiative and the ISO/PAS 17712 "High Security" grade.

Additional objects and advantages of the present invention shall become apparent as the description proceeds.

SUMMARY OF THE INVENTION

The present invention relates to a locking arrangement for securely sealing the doors of a freight container, wherein said container comprises:

a. two locking rods, each of which is fixed to one of each of said doors;

b. a handle pivotally connected to the first of said locking rods, said handle comprising a first opening situated at a location along its longitudinal length; and, c. a seal clasp joined to the first of said doors, said seal clasp comprising a second opening aligned with said first opening;

wherein, said arrangement comprises a sealing device comprising:

i. a bolt seal comprising:

1. an insertion bolt comprising an elongated body, an enlarged base and a securing tip; and, 2. a locking bush into which said securing tip is inserted;

ii. a cable comprising a first end and a second end joined to said bolt seal in a manner selected from the group consisting of:

1. said first end is joined to said insertion bolt and said second end is joined to said locking bush;

2. said first end is joined to said insertion bolt and said second end is joined to said insertion bolt; and, 3. said first end is joined to said locking bush and said second end is joined to said locking bush;

wherein, when said cable is wrapped around said locking rods, and when said insertion bolt is disposed through said first and second openings, then said doors are securely sealed.

Preferably, the thickness of the cable is less than 4 mm and at least 1 mm.

The cable further comprises a mechanism for tightening said cable around the locking rods, wherein said mechanism is selected from the group consisting of:

a. a one way pull through mechanism; and, b. a break-away screw.

Preferably, an identifying marking is situated on the insertion bolt and/or the locking bush.

Preferably, the sealing device further comprises an electronic seal.

The present invention further relates to a locking arrangement for securely sealing the doors of a freight container, wherein said container comprises:

a. two locking rods, each of which is fixed to one of each of said doors;

b. a handle pivotally connected to the first of said locking rods, said handle comprising a first opening situated at a location along its length; and, c. a seal clasp joined to the first of said doors, said seal clasp comprising a second opening aligned with said first opening;

wherein said arrangement comprises a sealing device comprising:

i. a bolt seal comprising:

1. an insertion bolt comprising an elongated body, an enlarged base and a securing tip; and, 2. a locking bush into which said securing tip is inserted;

ii. a cable disposed through a passageway in said bolt seal, said cable comprising a first end and a second end, which are joined to a mechanism for tightening said cable around the locking rods, The present invention still further relates to a method of securely sealing the door of a freight container, said method comprising:

a. providing a freight container comprising:

i. two locking rods, each of which is fixed to one of each of said doors;

ii. a handle pivotally connected to one of said locking rods, said handle comprising a first opening situated at a location along its length;

iii. a seal clasp joined to one of said doors, said seal clasp comprising a second opening aligned with said first opening, for fastening said handle to said door via said seal clasp at said openings;

b. providing a sealing device comprising:

i. a bolt seal comprising:

1. an insertion bolt comprising an elongated body, an enlarged base and a securing tip; and, 2. a locking bush into which said securing tip is inserted;

ii. a cable comprising a first end and a second end joined to said bolt seal in a manner selected from any one of the group consisting of:

1. said a first end is joined to said insertion bolt and said second end is joined to said locking bush;

2. said first end is joined to said insertion bolt and said second end is joined to said insertion bolt; and, 3. said first end is joined to said locking bush and said second end is joined to said locking bush;

c. wrapping said cable around said locking rods;

d. passing said elongated body of said insertion bolt through said first and second openings; and, e. inserting said securing tip of said insertion bolt to said locking bush.

The method further comprises:

f. providing a locking mechanism for tightening the cable around the locking rods; and, g. operating said locking mechanism, thereby tightening said cable around said locking rods.

The second end of the cable is joined to either the insertion bolt or the locking bush according to any one of the following ways:

a. prior to wrapping said cable around said locking rods; and, b. subsequent to wrapping said cable around said locking rods.

DETAILED DESCRIPTION OF THE PREFERRED EMBODIMENTS

All publications mentioned throughout this application are fully incorporated herein by reference, including all references cited therein.

Freight containers are often vulnerable to pilferage when being shipped from their original to final destination. The containers may be left unattended for extended periods of time, at which time a thief may attempt to break into the container and steal some or all of its contents, or terrorist may attempt to insert weapons or explosives into the container. It is therefore important for those involved with the transportation of the container to be able to easily determine whether the container's seal has been breached, at every stage of its transit. The present invention provides such a device, as well as a method for sealing and preventing a potential thief or terrorist from easily opening container doors.

The term, "container" as used herein refers to any form of sealable structure that is used to ship cargo. For instance, the container may take the form of the trailer portion of a truck or of a detachable, or stand-alone kind.

Figure 1:
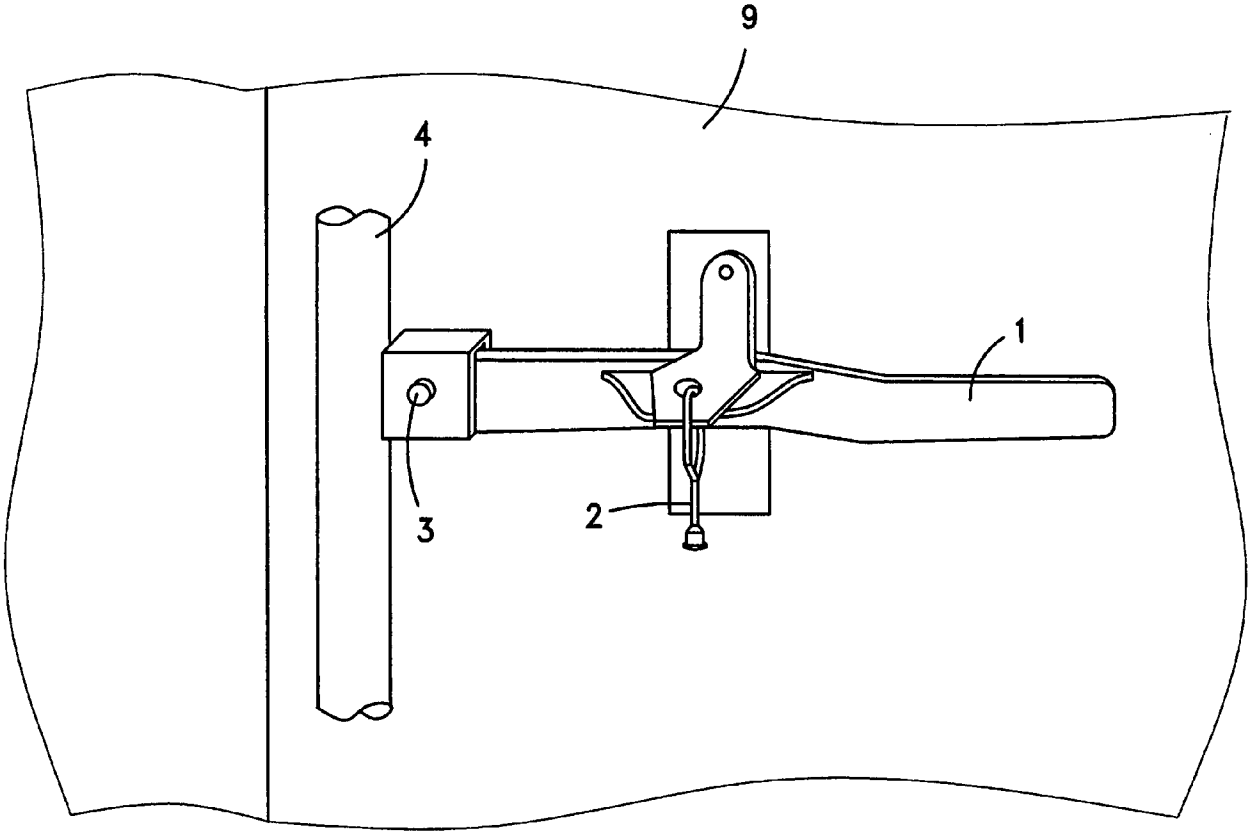
Fig. 1 (PRIOR ART)
FIG. 1 illustrates a close-up picture of a freight container locked with a traditional seal.
Figure 2:
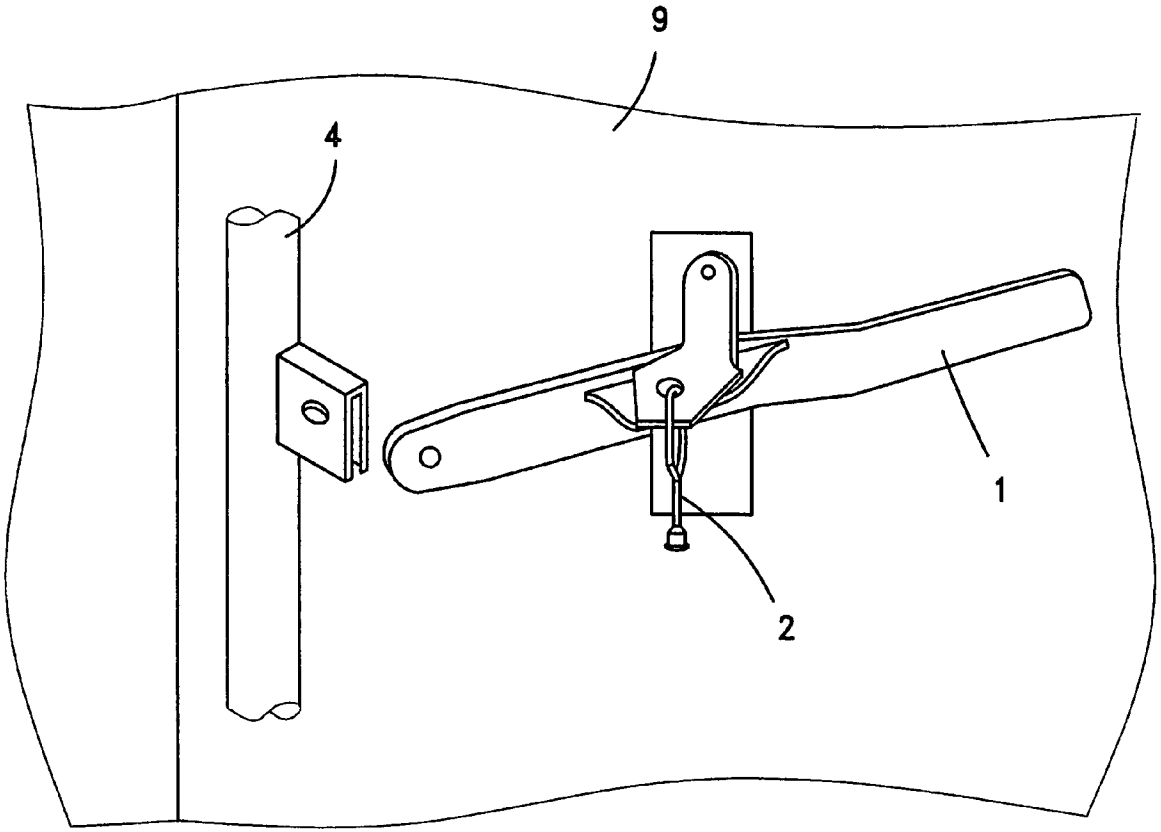
Fig. 2 (PRIOR ART)
FIG. 2 illustrates the picture of FIG. 1 wherein the pin that pivotally connects the handle to the locking rod has been removed.
Figure 3:
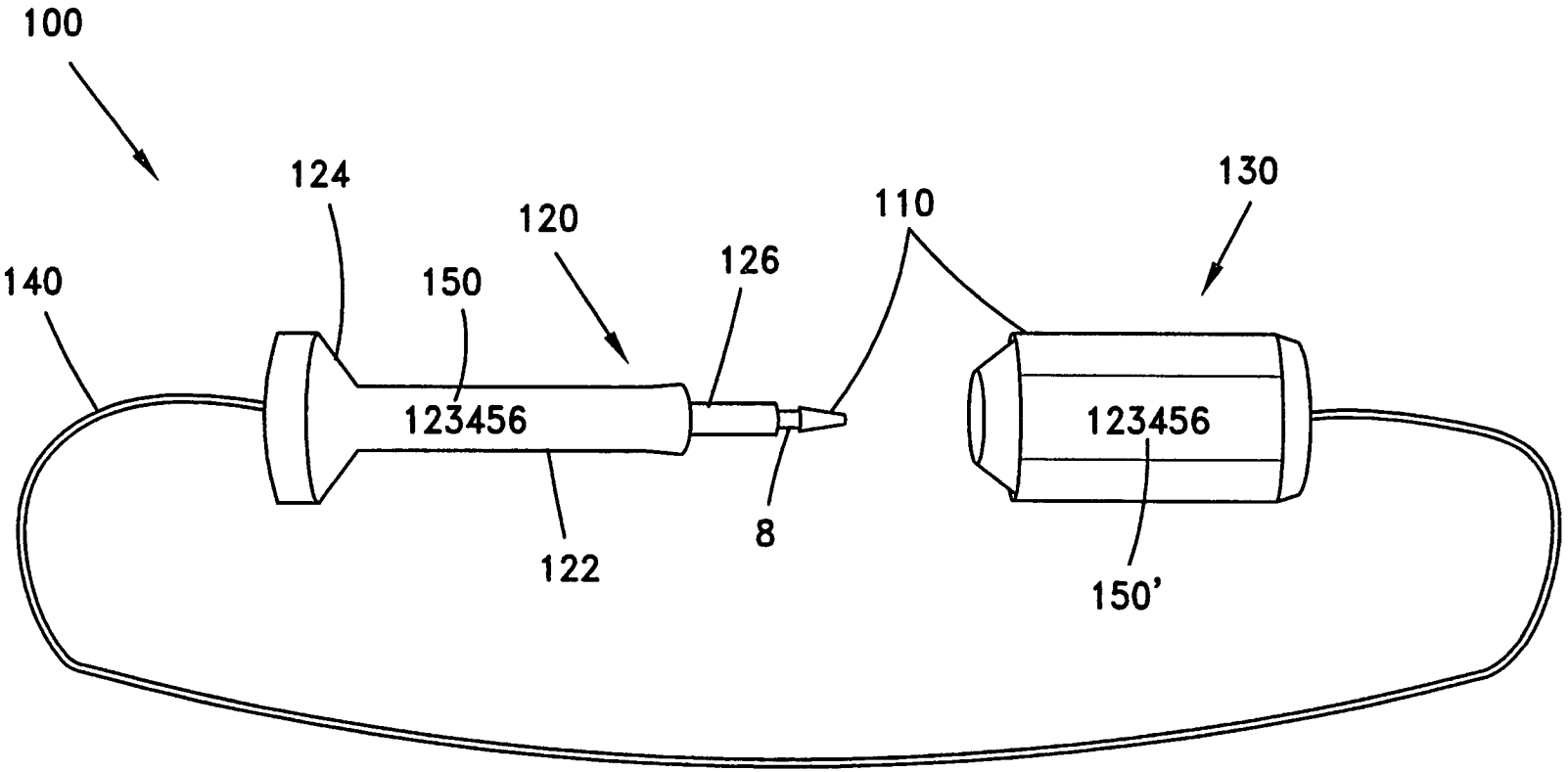
FIG. 3 illustrates a first embodiment of the sealing device of the present invention.

A first embodiment of the sealing device of the present invention, shown in FIG. 3 and generally indicated by the numeral (100), comprises a bolt seal (110) consisting of an insertion bolt (120) and a locking bush (130), and a cable (140). Insertion bolt (120) comprises an elongated body (122), an enlarged base (124) and a securing tip (126). Cable (140) is rigidly attached at one end directly to base (124) and rigidly attached at the other end directly to locking bush (130).

Insertion bolt (120) is preferably made from a heavy duty material such as steel which may be plastic-covered, and posses a strength that complies with the ISO/PAS 17712 "High Security" grade as described herein above. Cable (140) is flexible and preferably made of steel. Cable (140) may be of a lesser shear strength than the minimum requirement by the ISO/PAS 17712 "High Security" grade standard, since the main locking of the container is provided by the "High Security" grade bolt seal portion, as described herein below. Cable (140) provides an additional sealing protection, for which a cable (140) that conforms to the ISO shear standard is not necessary. Preferably, cable thickness is at least 1 mm. Hence, manufacturing costs, which translate to consumer costs, are significantly reduced. Nevertheless, it is understood that utilizing a 4 mm or thicker cable does fall within the scope of the present invention.

A unique identification mark (150), which may take the form of letters, numerals, a bar code, etc., is located on the outer surface of bush (130). A corresponding identification mark (150') is (optionally) located along elongated body (122) of insertion bolt (120).

Figure 4:
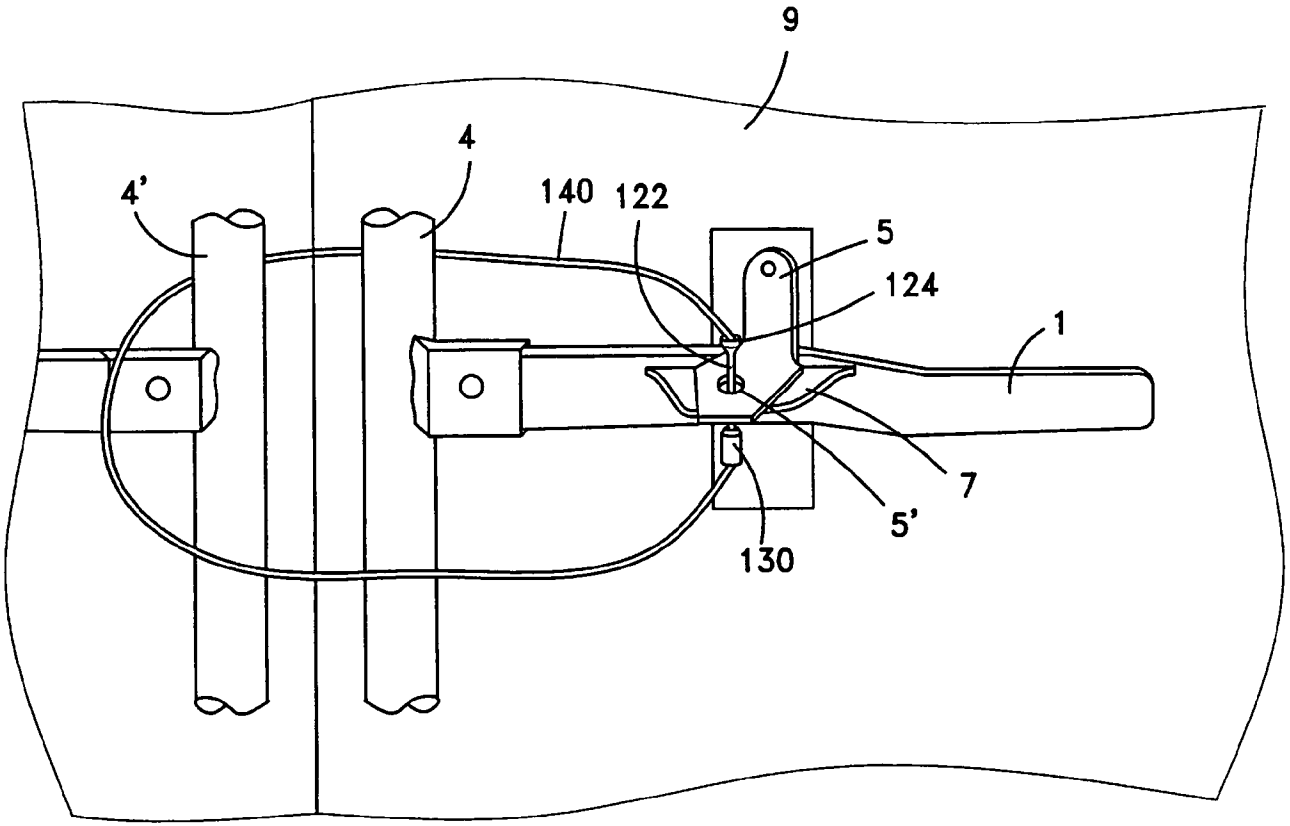
FIG. 4 illustrates the sealing device of the present invention disposed in a preferred arrangement.

A preferred locking arrangement of the sealing device (100) of the present invention is shown in FIG. 4. The opening (5') (first opening) of the rotatable portion of seal clasp (5) is aligned above the opening (second opening, not seen in the figures) in the lip (7) of handle (1). Elongated body (122) is disposed through the first and second openings, and securing tip (126) is disposed within locking bush (130). Cable (140) is wrapped around locking rods (4) and (4').

Bolt seals are well known in the art, therefore a technical description of the inner locking mechanism is not necessary. Nevertheless, briefly, the notch (8) situated at the tip of insertion bolt (120), as seen in FIG. 3, is inserted to locking bush (130) and typically caught by a spring mechanism such as a flexible c-ring, which prevents insertion bolt (120) from being allowed to be pulled out of locking bush (130).

Although cable (140) is shown herein as being wrapped only once around locking rods (4), (4'), forming a single loop, it is understood that the cable (140) may be looped around either bar (4), (4') to minimize the slack, depending on the length of cable (140) and the distance between locking rods (4), (4').

It is also understood that the design and arrangement of handle (1) and seal clasp (5) as shown in the figures herein is just one of many possible arrangements, and is shown herein as an illustrative but non-limitative example.

The maximum diameter of enlarged base (124) is greater than the maximum diameter of the first and second openings. Similarly, the maximum diameter of locking bush (130) is greater than the maximum diameter of the first and second openings. Thus, base (124) and bush (130) are prevented from being removed by sliding through the first and second openings.

The only way of disconnecting the sealing device (100) so that the container doors may be opened is by breaking bolt seal (110) or by cutting cable (140). Either way, indication of a security breach is evident upon even a cursory inspection of the seal and identification marks (150), (150'). Similarly, if a different seal is replaced in the appropriate arrangement, detection of incorrect identification marks (150) and (150') indicates a security breach.

Locking bush (130) preferably only covers securing tip (126) of insertion bolt (120) such that elongated body (122), and, in particular, identification mark (150), not seen in FIG. 4, may be visible upon inspection, even while insertion tip (122) is disposed within locking bush (130).

According to the arrangement shown in FIG. 4, handle (1) is sealed to the container door (9) in a traditional manner, i.e. with a seal, which prevents the handle from being allowed to rotate, thereby preventing the door from being opened. However, the seal is a bolt seal (110), which conforms to the current high security standards. Cable (140) is additionally provided for sealing the doors of the container. Since either one of the insertion bolt (120) or locking bush (130) cannot be easily spun when attached to a steel cable (140) the implementation of the "spinning" technique, as described herein above, is prevented.

Figure 5A:
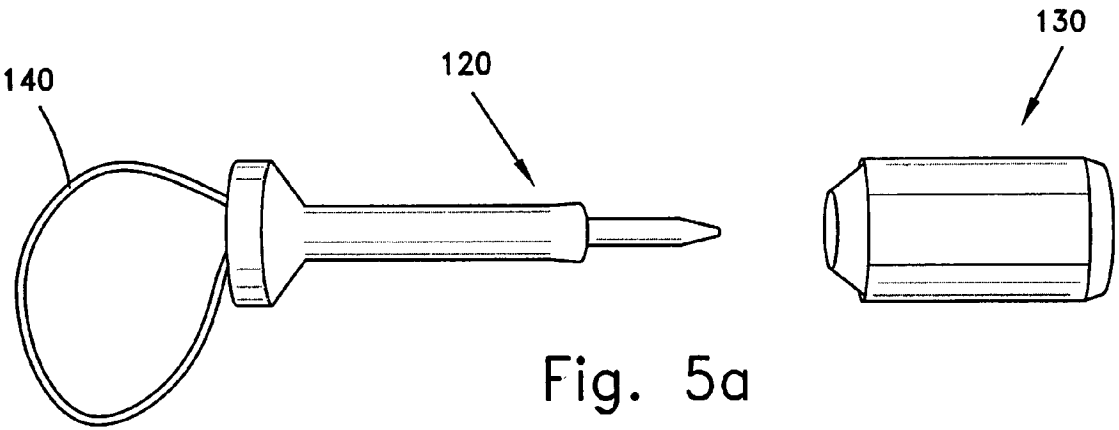
FIGS. 5*a* and 5*b* illustrate an alternative aspect of the first embodiment of the sealing device of the present invention.
Figure 5B:
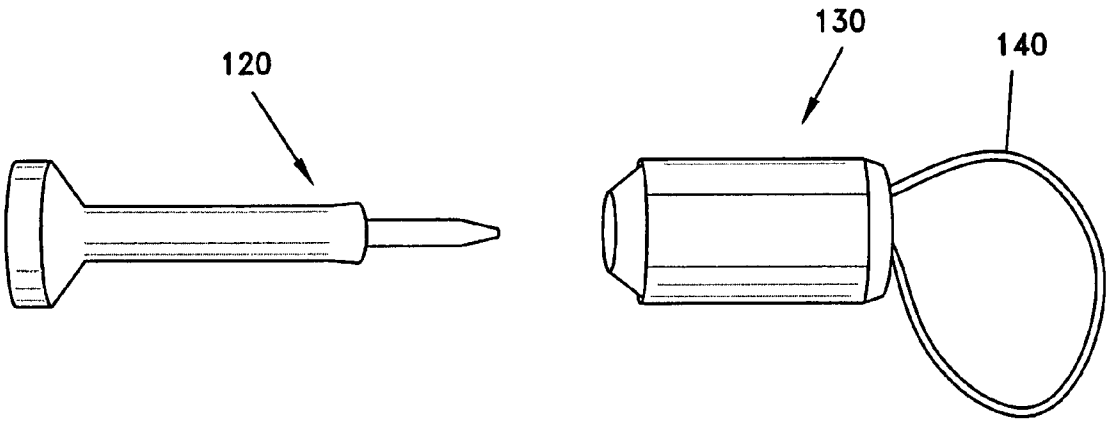
Figure 5C:
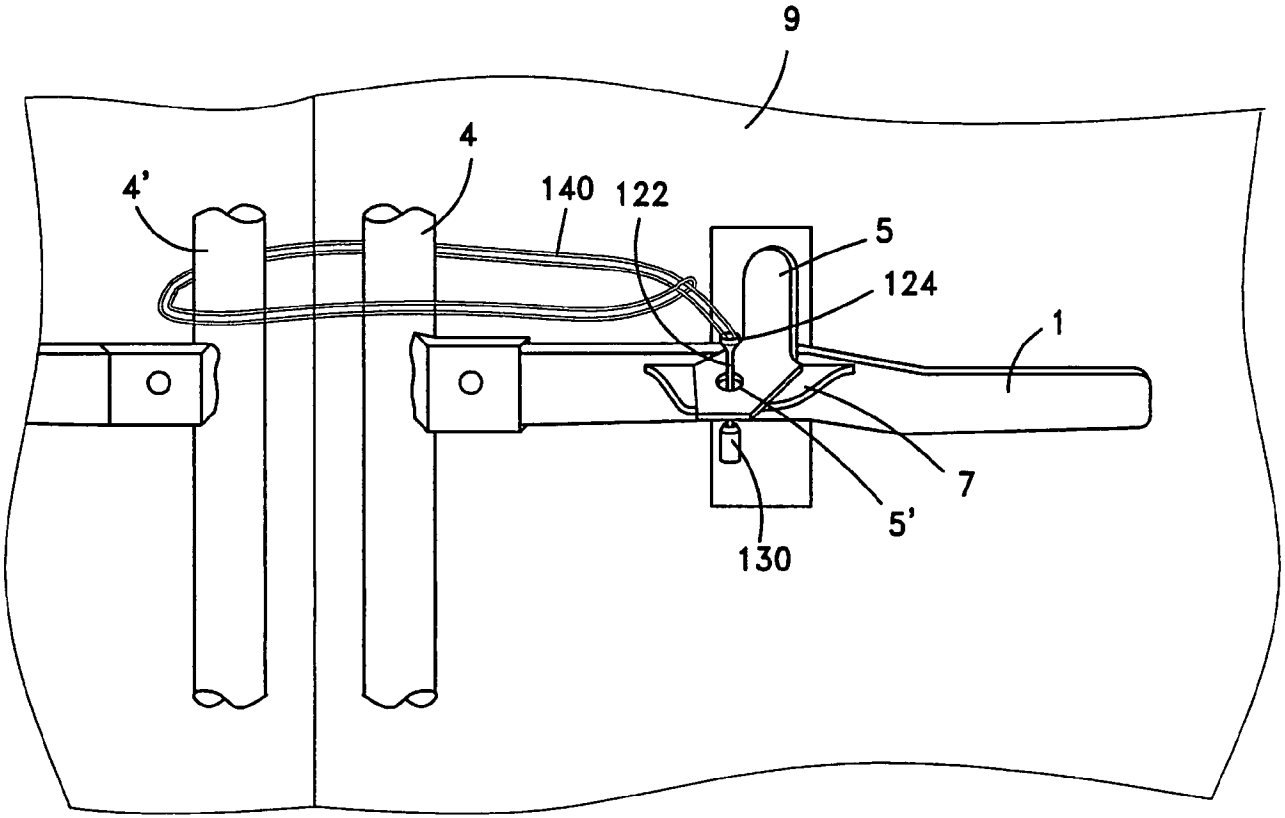
FIG. 5*c* illustrates a locking arrangement using the aspects of the first embodiment as shown in either one of FIGS. 5*a* and 5*b*.

According to an alternative aspect of the first embodiment of the sealing device (100) of the present invention, as shown in FIGS. 5*a* and 5*b*, both ends of cable (140) may be joined to insertion bolt (120). Alternatively, both ends of cable (140) may be joined to locking bush (130). According to each of these aspects, cable (140) is provided to the consumer with one end joined to either one of insertion bolt (120) or locking bush (130), and the other end free. After wrapping cable (140) around locking rods (4), (4'), the free end of cable (140) is joined to insertion bolt (120) or locking bush (130), for example, by crimping thereto or inserting into a suitable mechanism. Alternatively, cable (140) is provided to the consumer as shown in FIGS. 5*a* and 5*b*, wherein each end of cable (140) is joined to either insertion bolt (120) or locking bush (130). The loop formed by cable (140) is wrapped around locking rods (4), (4'), and insertion bolt (120) or locking bush (130) is pulled therethrough, for instance, as shown in FIG. 5*c*.

Figure 6:
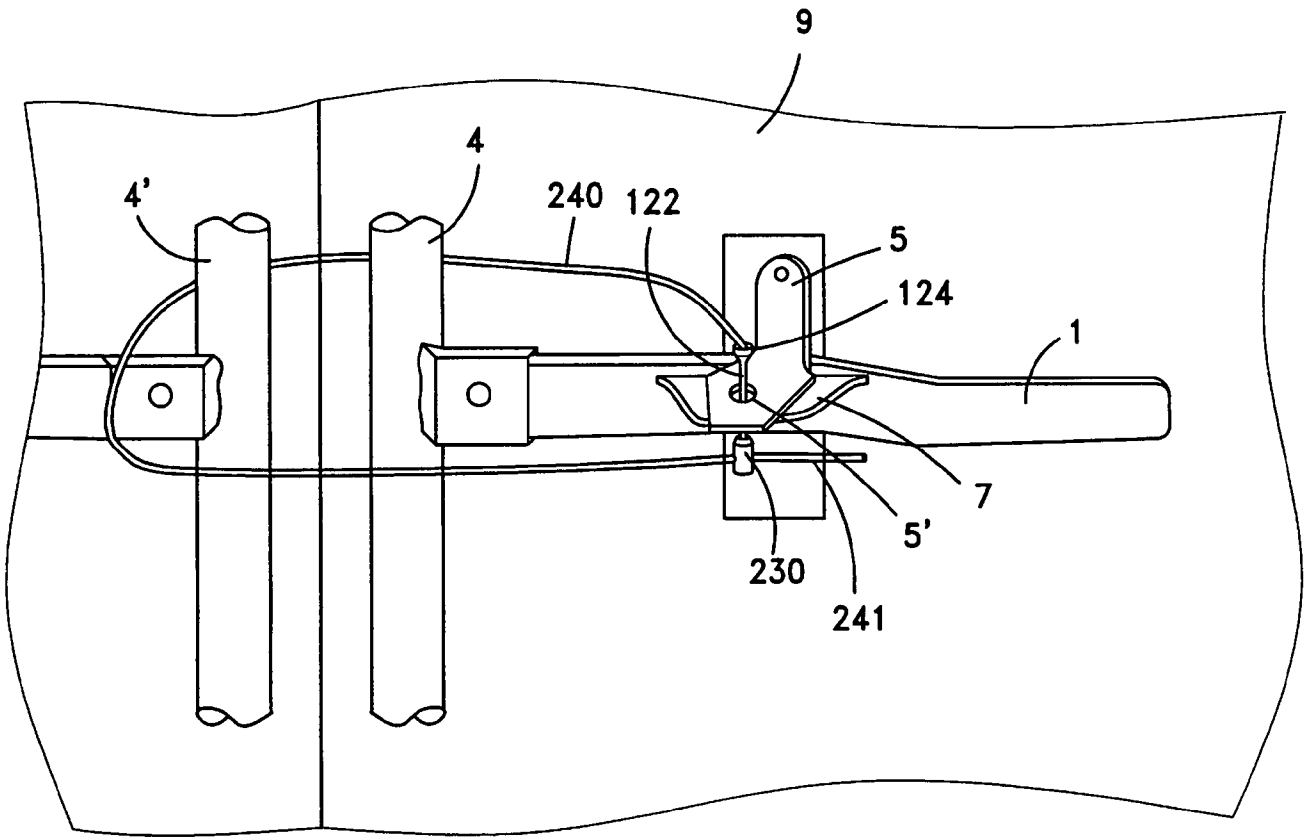
FIG. 6 illustrates a first aspect of the second embodiment of the sealing device of the present invention, disposed in a preferred arrangement.

As mentioned herein above, it is known that the distance between locking rods (4), (4') may vary from container to container. If cable (140) has too much slack, a thief may be capable of prying the doors open and removing some or all of the contents of the container. Therefore, a second embodiment of the present invention is shown in FIG. 6, comprising all of the components of the first embodiment, mutatis mutandis, with the following differences. Locking bush (230) comprises a mechanism for shortening the length of cable (240) in order to tightly wrap cable (240) around locking rods (4), (4'). The mechanism is a pull through (or, pull tight) mechanism, which is integrally incorporated in the locking bush (230). The free end (241) of cable (240) is pulled through locking bush (230) until the slack of cable (240) around rods (4), (4') is minimized, thereby preventing the container doors from being openable even a slight amount. Mechanical designs of pull through mechanisms are well known in the art, and therefore do not need to be described in their technical details herein. One example of such a mechanism is described in U.S. Pat. No. 5,647,620. Alternatively, the pull through mechanism is integrally incorporated within the bolt portion (not shown in the figures.)

Figure 7:
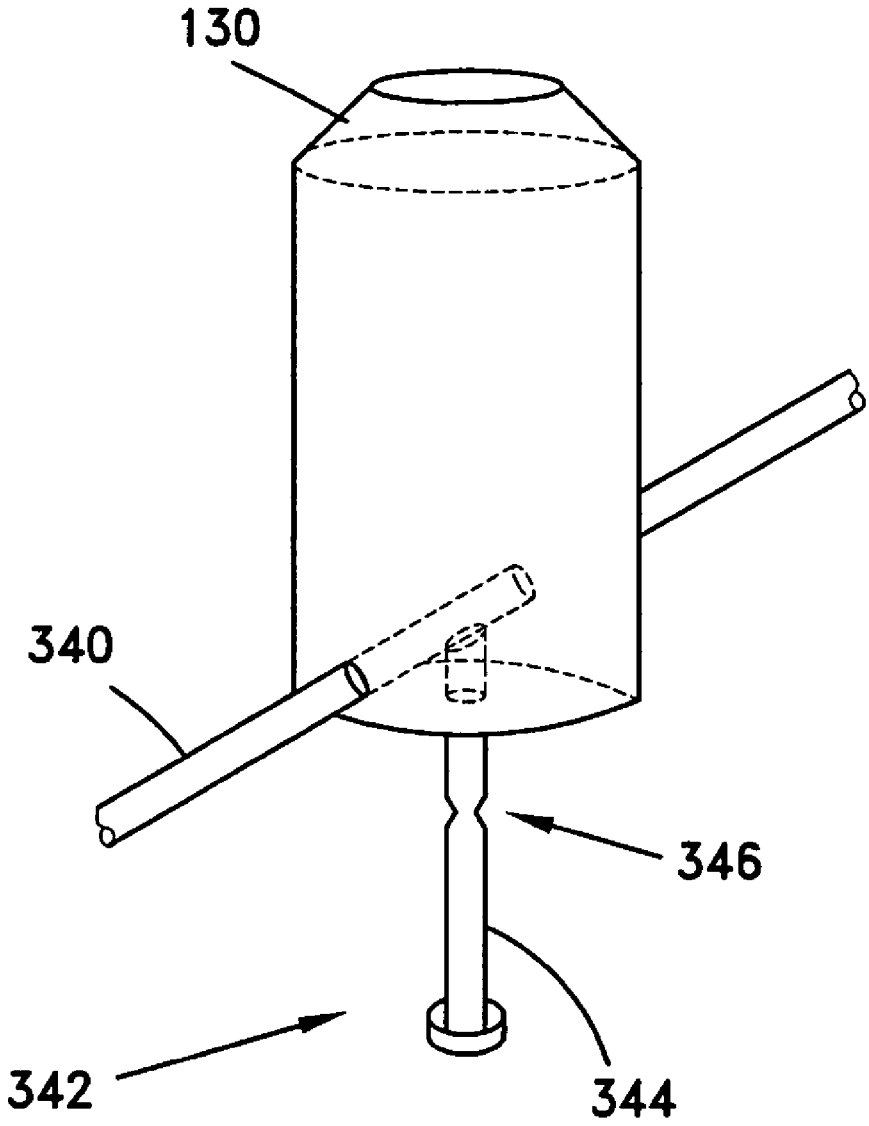
FIG. 7 illustrates a second aspect of the second embodiment of the sealing device of the present invention.

In an alternative aspect of the second embodiment of the present invention, locking bush (130) and a portion of cable (340) are shown schematically in FIG. 7, wherein cable (340) comprises a free end that is passed through a passageway in locking bush (130), and pulled until cable (340) is tightly wrapped around the locking rods. A break-away screw (342) is threaded through an opening in locking bush (130), essentially orthogonal to the longitudinal axis of the portion of cable (340) as cable (340) passes through the bore. When break-away screw (342) is sufficiently inserted through the opening, such that cable (340) is secured in locking bush (340), the outer portion (344) of break-away screw (342) is broken off at notch (346). The use of a break-way screw is well known in the art. The configuration described herein is just one example of numerous configurations that may be possible, and should be understood as illustrative and not limitative.

Figure 8:
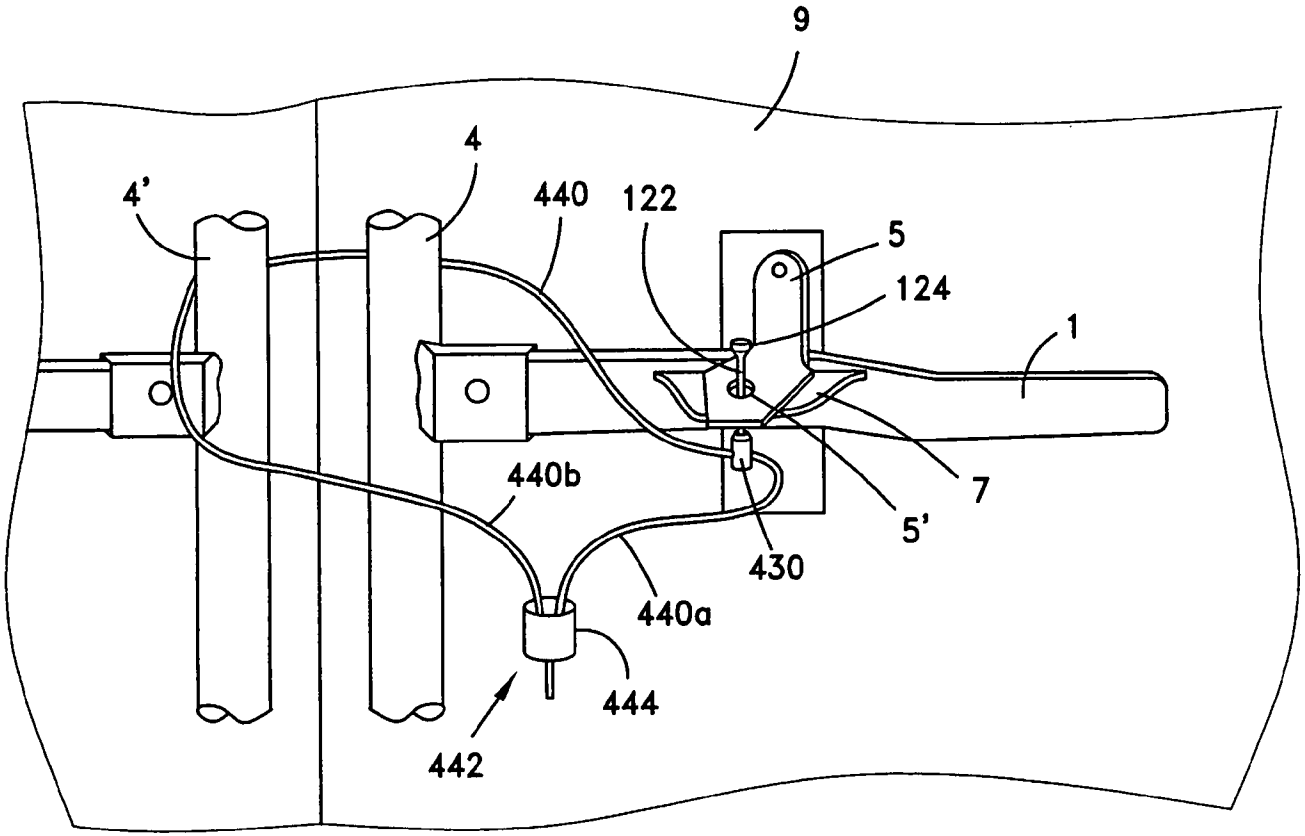
FIG. 8 illustrates a second embodiment of the sealing device of the present invention.

A third embodiment, shown in FIG. 8, comprises all of the components of the first two embodiments, mutatis mutandis, with the following differences. Locking bush (430) comprises a passageway for allowing cable (440) to pass therethrough. The first end (440*a*) of cable (440) is fixedly joined to housing (444) of pull through mechanism (442). The second end (440*b*) of cable (440) passes through housing (444), and is pulled until the slack of cable (440) around rods (4), (4') is minimized. Alternatively to passing through the locking bush, a passageway for cable (440) may run through the insertion bolt (122), for instance, through enlarged base (124), or through the longitudinal length of the bolt seal.

According to all of the embodiments described herein, it may be desirable for sealing device (100) to further comprise an electronic seal (not shown in the figures). The electronic seal is a relatively new technology that is utilized in the sealing of freight containers. An electronic seal may be used, for instance, to read the identification mark and/or monitor the integrity of sealing device (100) en route. Information may be gathered on site, or, may be transmitted to a remote location. The electronic seal may be situated on bolt seal (110) as an integral portion of, or fixedly attached to insertion bolt (120) or to locking bush (130), or along cable (140).

In an alternative arrangement of the embodiments of the tamper indication device of the present invention, the cable may be passed through a suitable opening located at the container door in addition to or instead of being wrapped around locking rods (4), (4')

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A locking arrangement securely sealing the doors of a freight container, wherein said container comprises:

a. two locking rods, each of which is fixed to one of each of said doors;

b. a handle pivotally connected to the first of said locking rods, said handle comprising a first opening situated at a location along its longitudinal length; and, c. a seal clasp joined to the first of said doors, said seal clasp comprising a second opening aligned with said first opening;

said locking arrangement comprises a sealing device comprising:

a. a bolt seal comprising:

i. an insertion bolt comprising an elongated body, an enlarged base having a diameter larger than the diameters of said first and said second openings and significantly larger than the diameter of said elongated body, and a securing tip; and, ii. a locking bush having a diameter larger than the diameters of said first and said second openings into which said securing tip is inserted;

b. a cable comprising a first end joined to said insertion bolt and a second end joined to said locking bush;

wherein, when said cable is wrapped around said locking rods, when said insertion bolt is disposed through said first and second openings, and when said securing tip is disposed within said locking bush, said larger diameters of said enlarged base and said locking bush prevent said bolt seal from being slid through said openings, thereby preventing said doors from being opened.

2. An arrangement according to claim 1, wherein the thickness of the cable is less than 4 mm.

3. An arrangement according to claim 1, wherein the thickness of the cable is at least 1 mm.

4. An arrangement according to claim 1, wherein an identifying marking is situated on the insertion bolt.

5. An arrangement according to claim 1, wherein an identifying marking is situated on the locking bush.

6. An arrangement according to claim 1, wherein the sealing device further comprises an electronic seal.

7. A method of securely sealing the door of a freight container, said freight container comprising:

i. two locking rods, each of which is fixed to one of each of said doors;

ii. a handle pivotally connected to one of said locking rods, said handle comprising a first opening situated at a location along its length;

iii. a seal clasp joined to one of said doors, said seal clasp comprising a second opening aligned with said first opening, for fastening said handle to said door via said seal clasp at said openings;

said method comprising:

A. providing a sealing device comprising:

a. a bolt seal comprising:

i. an insertion bolt comprising an elongated body, an enlarged base having a diameter larger than the diameters of said first and said second openings and significantly larger than the diameter of said elongated body, and a securing tip; and, ii. a locking bush having a diameter larger than the diameters of said first and said second openings into which said securing tip is inserted;

b. a cable comprising a first end joined to said insertion bolt and a second end joined to said locking bush;

B. wrapping said cable around said locking rods;

C. passing said elongated body of said insertion bolt through said first and second openings; and, D. inserting said securing tip of said insertion bolt to said locking bush.

8. A method according to claim 7, wherein the second end of the cable is joined to either the insertion bolt or the locking bush according to any one of the following ways:

a. prior to wrapping said cable around said locking rods; and, b. subsequent to wrapping said cable around said locking rods.

* * * * *